US009908668B2

(12) United States Patent
Wilkes et al.

(10) Patent No.: US 9,908,668 B2
(45) Date of Patent: Mar. 6, 2018

(54) FLEXIBLE CONTAINER

(71) Applicant: Dow Global Technologies LLC, Midland, MI (US)

(72) Inventors: Kenneth R. Wilkes, Asheville, NC (US); Marlos G. Oliveira, Sao Paulo (BR); Marcos P. Franca, Sao Paulo (BR)

(73) Assignee: Dow Global Technologies LLC, Midland, MI (US)

( * ) Notice: Subject to any disclaimer, the term of this patent is extended or adjusted under 35 U.S.C. 154(b) by 281 days.

(21) Appl. No.: 14/701,829

(22) Filed: May 1, 2015

(65) Prior Publication Data

US 2015/0314928 A1 Nov. 5, 2015

Related U.S. Application Data

(60) Provisional application No. 61/988,591, filed on May 5, 2014.

(51) Int. Cl.

| | |
|---|---|
| ***B65D 47/06*** | (2006.01) |
| ***B65D 33/06*** | (2006.01) |
| ***B65D 37/00*** | (2006.01) |
| ***B65D 75/00*** | (2006.01) |
| ***B65D 75/28*** | (2006.01) |

(Continued)

(52) U.S. Cl.

CPC ..... *B65D 47/06* (2013.01); *B65D 33/06* (2013.01); *B65D 37/00* (2013.01); *B65D 75/008* (2013.01); *B65D 75/28* (2013.01); *B65D 75/563* (2013.01); *B65D 75/5883* (2013.01)

(58) Field of Classification Search

CPC ..... B65D 47/06; B65D 33/06; B65D 37/00; B65D 75/008; B65D 75/28; B65D 75/563; B65D 75/5883

See application file for complete search history.

(56) References Cited

U.S. PATENT DOCUMENTS 6,126,315 A * 10/2000 Ichikawa ..... B65D 31/10 383/104

6,832,852 B2 12/2004 Wilkes (Continued)

FOREIGN PATENT DOCUMENTS

DE 1934749 A1 1/1971

DE 2635366 A1 2/1978

(Continued)

OTHER PUBLICATIONS

The Dow Chemical Company, DOWLEX Polyethylene Resins, Feb. 17, 2010, pp. 1-2.*

*Primary Examiner* — Nicholas J Weiss

(74) *Attorney, Agent, or Firm* — Husch Blackwell LLP

(57) ABSTRACT

The present disclosure provides a flexible container having four panels—a front panel, a rear panel, and opposing gusseted side panels. The front panel bottom face includes a first line defined by the inner edge of a first peripheral tapered seal and a second line defined by the inner edge of a second peripheral tapered seal. The first line intersects the second line at an apex point in a bottom seal area. The front panel bottom face has a bottom distalmost inner seal point on the inner edge and the apex point is separated from the bottom distalmost inner seal point by a distance from 0 mm to less than 8.0 mm.

19 Claims, 8 Drawing Sheets

(51) Int. Cl.
*B65D 75/56* (2006.01)
*B65D 75/58* (2006.01)

(56) References Cited

U.S. PATENT DOCUMENTS

| | | | | |
|---|---|---|---|---|
| 7,005,150 | B2 * | 2/2006 | Kuge | B65D 31/06 383/104 |
| 7,147,597 | B2 | 12/2006 | Wilkes | |
| 7,407,326 | B2 | 8/2008 | Wilkes | |
| 8,231,029 | B2 | 7/2012 | Peer et al. | |
| 8,348,509 | B2 | 1/2013 | Wilkes et al. | |
| 2002/0131654 | A1 | 9/2002 | Smith et al. | |
| 2003/0059130 | A1 * | 3/2003 | Yoneyama | B65D 75/008 383/10 |
| 2005/0031230 | A1 * | 2/2005 | Emst | B65D 75/008 383/107 |
| 2011/0056965 | A1 | 3/2011 | Peer et al. | |
| 2011/0069908 | A1 | 3/2011 | Wilkes et al. | |
| 2013/0121622 | A1 | 5/2013 | Wilkes et al. | |
| 2013/0305664 | A1 * | 11/2013 | Arroyo Yillan | B29C 65/02 53/469 |
| 2016/0016695 | A1 * | 1/2016 | Pereira | B65D 37/00 383/6 |

FOREIGN PATENT DOCUMENTS

| | | | |
|---|---|---|---|
| EP | 0899084 | A1 | 3/1999 |
| JP | H10211930 | A | 8/1998 |

* cited by examiner

FLEXIBLE CONTAINER

BACKGROUND

The present disclosure is directed to a flexible container for dispensing a flowable material.

Known are flexible containers with a gusseted body section. These gusseted flexible containers are currently produced using flexible films which are folded to form gussets and heat sealed in a perimeter shape. The gusseted body section opens to form a flexible container with a square cross section or a rectangular cross section. The gussets are terminated at the bottom of the container to form a substantially flat base, providing stability when the container is partially or wholly filled.

When a filled gusseted flexible container is dropped, burst or leakage may occur, resulting in lost product, waste, spill damage, and clean-up cost. Desired is a gusseted flexible container with improved drop strength, including improved side drop strength.

SUMMARY

The present disclosure provides a flexible container. The flexible container includes:

A. a front panel, a rear panel, a first gusseted side panel, and a second gusseted side panel, the gusseted side panels adjoining the front panel and the rear panel along peripheral seals to form a chamber;

B. each panel includes a bottom face comprising two opposing peripheral tapered seals, each peripheral tapered seal extending from a respective peripheral seal, each peripheral tapered seal comprising an inner edge, the peripheral tapered seals converging at a bottom seal area;

C. the front panel bottom face comprises a first line defined by the inner edge of the first peripheral tapered seal and a second line defined by the inner edge of the second peripheral tapered seal inner edge, the first line intersecting the second line at an apex point in the bottom seal area;

D. the front panel bottom face has a bottom distalmost inner seal point on the inner edge; and E. the apex point is separated from the bottom distalmost inner seal point by a distance from 0 mm to less than 8.0 mm.

DETAILED DESCRIPTION

The present disclosure provides a flexible container. The flexible container includes:

A. A front panel, a rear panel, a first gusseted side panel, and a second gusseted side panel, the gusseted side panels adjoining the front panel and the rear panel along peripheral seals to form a chamber.

B. Each panel includes a bottom segment comprising two opposing peripheral tapered seals, each peripheral tapered seal extending from a respective peripheral seal, each peripheral tapered seal comprising an inner edge, the peripheral tapered seals converging at a bottom seal area.

C. The front panel bottom segment includes a first line defined by the inner edge of the first peripheral tapered seal and a second line defined by the inner edge of the second peripheral tapered seal, the first line intersecting the second line at an apex point in the bottom seal area.

D. The front panel bottom segment has a bottom distalmost inner seal point on the inner edge.

E. The apex point is separated from the bottom distalmost inner seal point by a distance from 0 mm to less than 8.0 mm.

Figure 1:
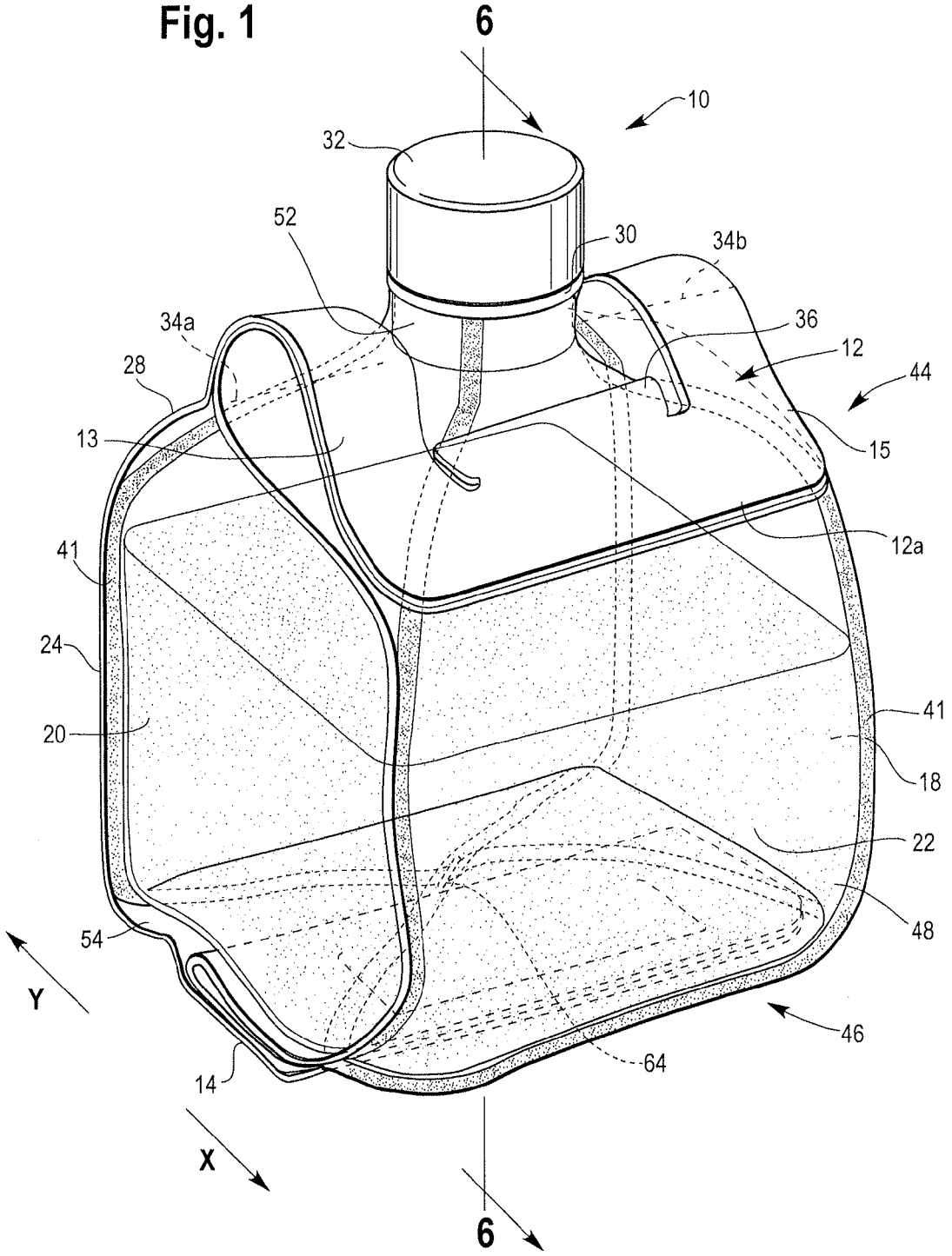
FIG. 1 is a perspective view of a filled flexible container having top and bottom flexible handles in a rest position.
Figure 2:
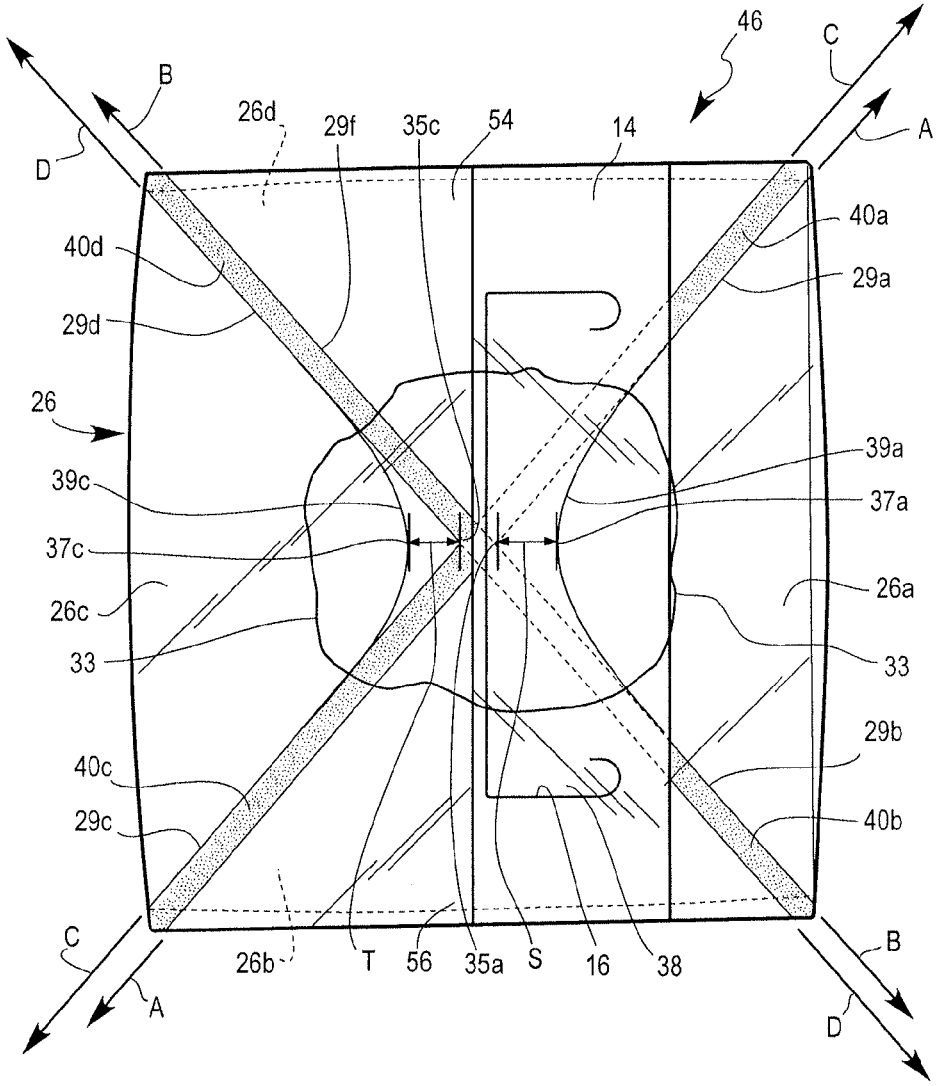
FIG. 2 is a bottom plan view of the flexible container of FIG. 1.

FIGS. 1-2 show a flexible container 10 having a flexible top 12 and a bottom 14. The flexible container 10 has four panels, a front panel 22, a back panel 24, a first gusset panel 18 and a second gusset panel 20. The four panels 18, 20, 22, and 24 extend toward a top end 44 and a bottom end 46 of the container 10 to form the top segment 28 and bottom segment 26, respectively. When the container 10 is inverted, the top and bottom positions in relation to the container 10 change. However, for consistency the handle adjacent the spout 30 will be called the top or upper handle 12 and the opposite handle will be called the bottom or lower handle 14. Likewise, the top or upper portion, segment or panel will be the surface adjacent the spout 30, and the bottom or lower portion, segment, or panel will be the surface opposite the top segment.

The four panels 18, 20, 22 and 24 can each be composed of a separate web of film. The composition and structure for each web of film can be the same or different. Alternatively, one web of film may also be used to make all four panels and the top and bottom segments. In a further embodiment, two or more webs can be used to make each panel.

In an embodiment, four webs of film are provided, one web of film for each respective panel 18, 20, 22, and 24. The edges of each film are sealed to the adjacent web of film to form peripheral seals 41 (FIG. 1). The peripheral tapered seals 40*a*-40*d* are located on the bottom segment 26 of the container as shown in FIG. 2. The peripheral seals 41 are located on the side edges of the container 10.

To form the top segment 28 and the bottom segment 26, the four webs of film converge together at the respective end and are sealed together. For instance, the top segment 28 can be defined by extensions of the panels sealed together at the top end 44 and when the container 10 is in a rest position it can have four top panels 28*a*-28*d* (FIG. 4) of film that define the top segment 28. The bottom segment 26 can also have four bottom panels 26*a*-26*d* of film sealed together and can also be defined by extensions of the panels at the opposite end 46 as shown in FIG. 2.

In an embodiment, a portion of the four webs of film that make up the top segment 28 terminate at a spout 30. A portion of a top end section of each of the four webs of film is sealed, or otherwise welded, to an outer, lower rim 52 of the spout 30 to form a tight seal. The spout is sealed to the flexible container by way of compression heat seal, ultrasonic seal, and combinations thereof. Although the base of spout 30 has a circular cross-sectional shape, it is understood that the base of spout 30 can have other cross-sectional shapes such as a polygonal cross-sectional shape, for example. The base with circular cross-sectional shape is distinct from fitments with canoe-shaped bases used for conventional two-panel flexible pouches.

In an embodiment, the outer surface of the base of spout 30 has surface texture. The surface texture can include embossment and a plurality of radial ridges to promote sealing to the inner surface of the top segment 28.

In an embodiment, the spout 30 excludes fitments with oval, wing-shaped, eye-shaped, or canoe-shaped bases.

Figure 5:
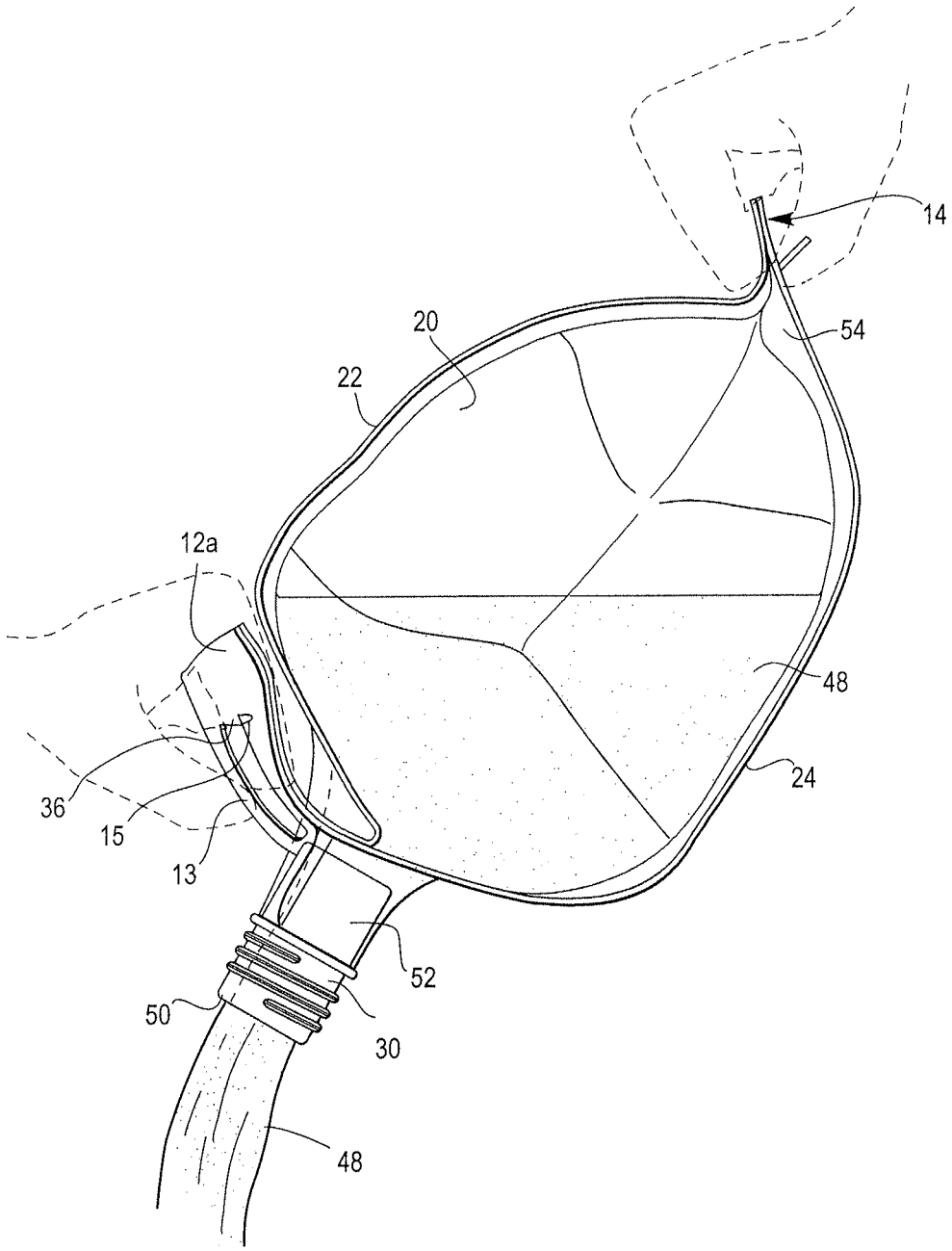
FIG. 5 is a side plan view of the flexible container of FIG. 11 in an inverted position for transferring the contents.
Figure 6:
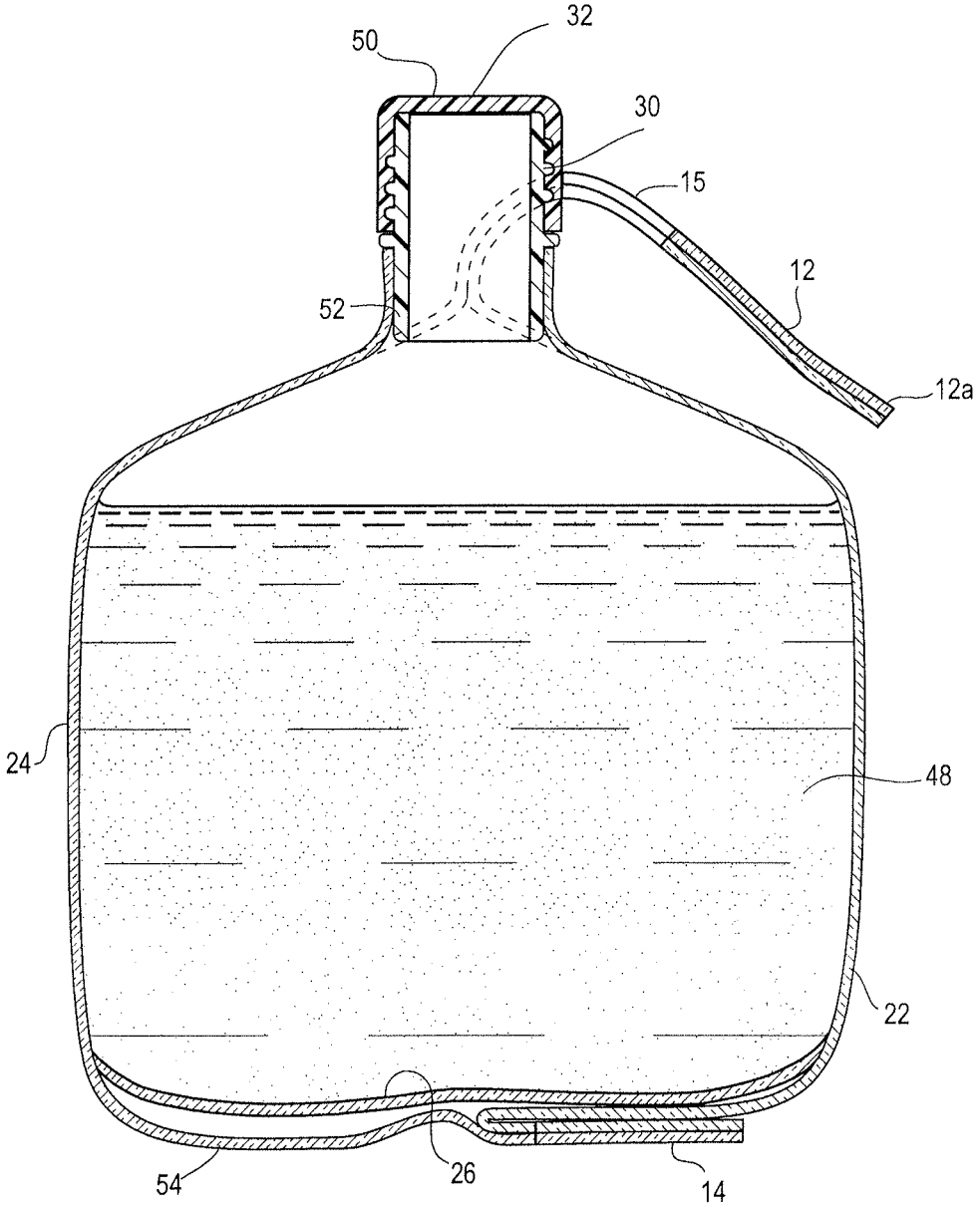
FIG. 6 is a cross-sectional view taken along the line 6-6 of FIG. 1.

Furthermore, the spout 30 can contain a removable closure 32. The spout 30 has an access opening 50 through the top segment 28 to the interior as shown in FIGS. 5-6. Alternatively, the spout 30 can be positioned on one of the panels, where the top segment would then be defined as an upper seal area defined by the joining together of at least two panel ends. In a further embodiment, the spout 30 is positioned at generally a midpoint of the top segment 28 and can be sized smaller than a width of the container 10, such that the access opening 50 of the spout 30 can have an area that is less than a total area of the top segment 28. In yet a further embodiment, the spout area is not more than 20% of the total top segment area. This can ensure that the spout 30 and its associated access opening 50 will not be large enough to insert a hand therethrough, thus avoiding any unintentional contact with the product 58 stored therein.

The spout 30 can be made of a rigid construction and can be formed of any appropriate plastic, such as high density polyethylene (HDPE), low density polyethylene (LDPE), polypropylene (PP), and combinations thereof. The location of the spout 30 can be anywhere on the top segment 28 of the container 10. In an embodiment the spout 30 is located at the center or midpoint of the top segment 28. The closure 32 covers the access opening 50 and prevents the product from spilling out of the container 10. The cap 32 may be a screw-on cap, a flip-top cap or other types of removable (and optionally reclosable) closures.

As shown in FIGS. 1-2, the flexible bottom handle 14 can be positioned at a bottom end 46 of the container 10 such that the bottom handle 14 is an extension of the bottom segment 26.

Each panel includes a respective bottom face. FIG. 2 shows four triangle-shaped bottom faces 26*a*, 26*b*, 26*c*, 26*d*, each bottom face being an extension of a respective film panel. The bottom faces 26*a*-26*d* make up the bottom segment 26. The four panels 26*a*-26*d* come together at a midpoint of the bottom segment 26. The bottom faces 26*a*-26*d* are sealed together, such as by using a heat-sealing technology, to form the bottom handle 14. For instance, a weld can be made to form the bottom handle 14, and to seal the edges of the bottom segment 26 together. Nonlimiting examples of suitable heat-sealing technologies include hot bar sealing, hot die sealing, impulse sealing, high frequency sealing, or ultrasonic sealing methods.

Figure 7:
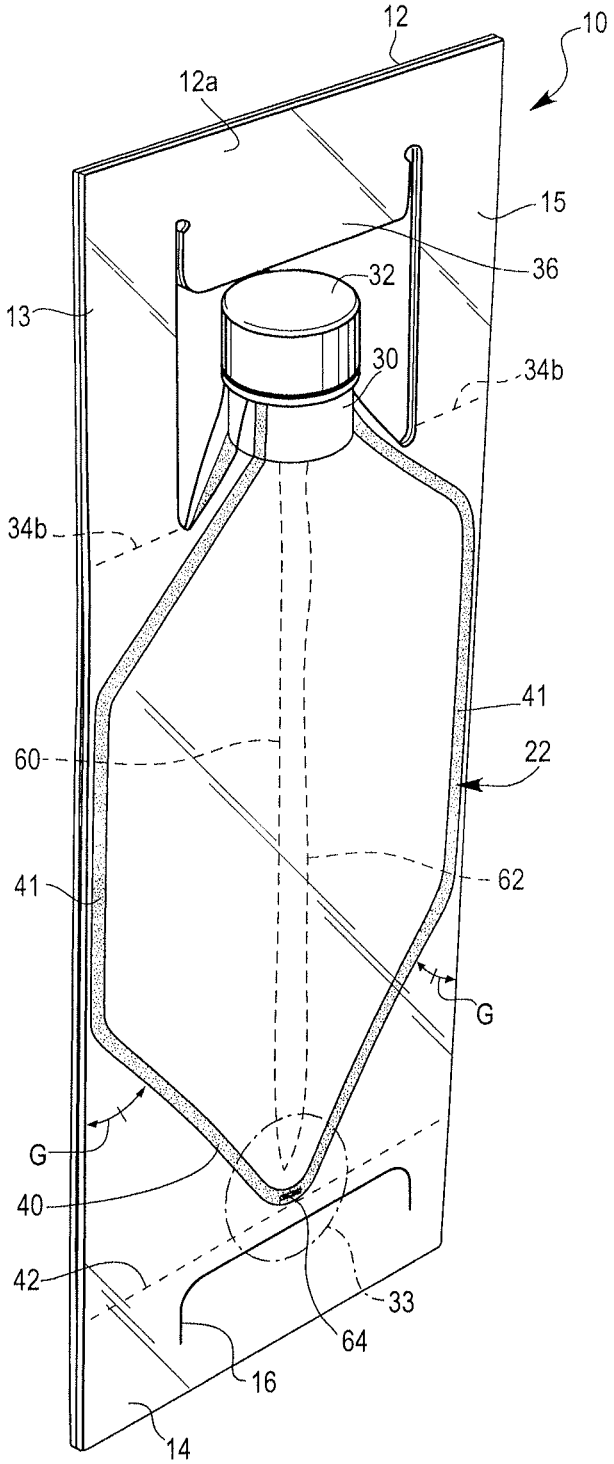
FIG. 7 is a perspective view of the container of FIG. 1 in a collapsed configuration.
Figure 8:
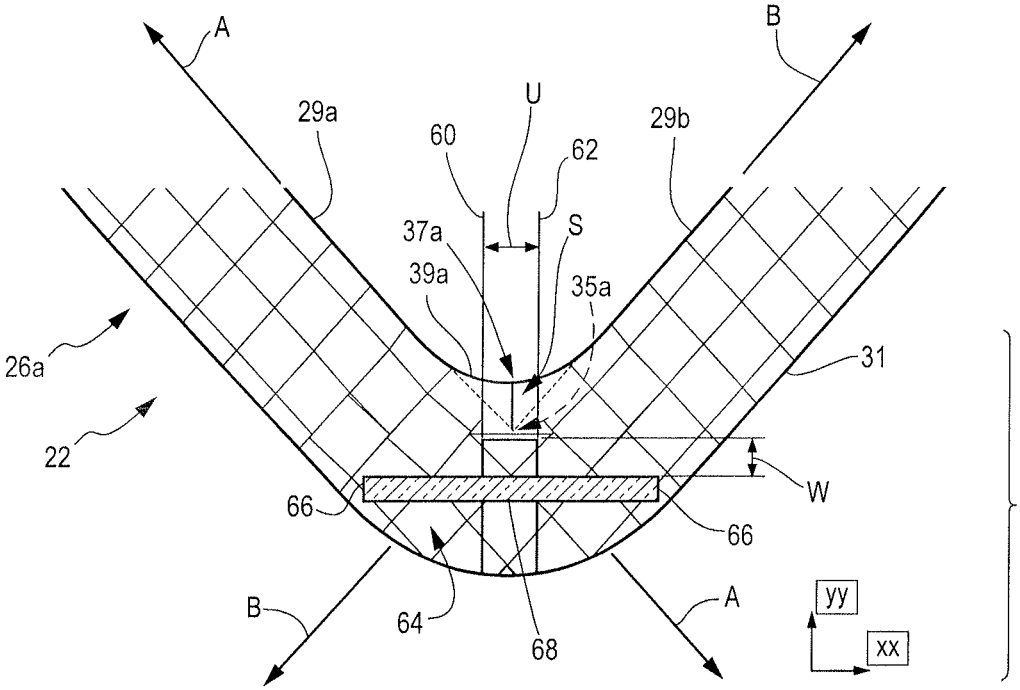
FIG. 8 is an enlarged view of the bottom seal area of FIG. 7.

FIG. 2 shows bottom segment 26. Each panel 18, 20, 22, 24 has a respective bottom face 26*a*-26*d* that is present in the bottom segment 26. Each bottom face is bordered by two opposing peripheral tapered seals 40*a*, 40*b*, 40*c*, 40*d*. Each peripheral tapered seal 40*a*-40*d* extends from a respective peripheral seal 41. The peripheral tapered seals for the front panel 22 and the rear panel 24 have an inner edge 29*a*-29*d* (FIG. 2) and an outer edge 31 (FIG. 8). The peripheral tapered seals 40*a*-40*d* converge at a bottom seal area 33 (FIG. 2, FIG. 7, FIG. 8).

The front panel bottom face 26*a* includes a first line A defined by the inner edge 29*a* of the first peripheral tapered seal 40*a* and a second line B defined by the inner edge 29*b* of the second peripheral tapered seal 40*b*. The first line A intersects the second line B at an apex point 35*a* in the bottom seal area 33. The front panel bottom face 26*a* has a bottom distalmost inner seal point 37*a* ("BDISP 37*a*"). The BDISP 37*a* is located on an inner seal edge defined by inner edge 29*a* and inner edge 29*b*.

The apex point 35*a* is separated from the BDISP 37*a* by a distance S from 0 millimeter (mm) to less than 8.0 mm.

In an embodiment, the rear panel bottom face 26*c* includes an apex point similar to the apex point on the front panel bottom face. The rear panel bottom face 26*c* includes a first line C defined by the inner edge of the 29*c* first peripheral tapered seal 40*c* and a second line D defined by the inner edge 29*d* of the second peripheral tapered seal 40*d*. The first line C intersects the second line D at an apex point 35*c* in the bottom seal area 33. The rear panel bottom face 26*c* has a bottom distalmost inner seal point 37*c* ("BDISP 37*c*"). The BDISP 37*c* is located on an inner seal edge defined by inner edge 29*c* and inner edge 29*d*. The apex point 35*c* is separated from the BDISP 37*c* by a distance T from 0 millimeter (mm) to less than 8.0 mm.

It is understood the following description to the front panel bottom face applies equally to the rear panel bottom face, with reference numerals to the rear panel bottom face shown in adjacent closed parentheses.

In an embodiment, the BDISP 37*a* (37*c*) is located where the inner edges 29*a* (29*c*) and 29*b* (29*d*) intersect. The distance between the BDISP 37*a* (37*c*) and the apex point 35*a* (35*c*) is 0 mm.

In an embodiment, the inner seal edge diverges from the inner edges 29*a*, 29*b* (29*c*, 29*d*), to form a distal inner seal arc 39*a* (front panel) a distal inner seal arc 39*c* (rear panel) as shown in FIGS. 2 and 8. The BDISP 37*a* (37*c*) is located on the inner seal arc 39*a* (39*c*). The apex point 35*a* (apex point 35*c*) is separated from the BDISP 37*a* (BDISP 37*c*) by the distance S (distance T) which is from greater than 0 mm, or 1.0 mm, or 2.0 mm, or 2.6 mm, or 3.0 mm, or 3.5 mm, or 3.9 mm, to 4.0 mm, or 4.5 mm, or 5.0 mm, or 5.2 mm, or 5.3 mm, or 5.5 mm, or 6.0 mm, or 6.5 mm, or 7.0 mm, or 7.5 mm, or 7.9 mm.

In an embodiment, apex point 35*a* (35*c*) is separated from the BDISP 37*a* (37*c*) by the distance S (distance T) which is from greater than 0 mm to less than 6.0 mm.

In an embodiment, the distance from S (distance T) from the apex point 35*a* (35*c*) to the BDISP 37*a* (37*c*) is from greater than 0 mm, or 0.5 mm or 1.0 mm, or 2.0 mm to 4.0 mm or 5.0 mm or less than 5.5 mm.

In an embodiment, apex point 35*a* (apex point 35*c*) is separated from the BDISP 37*a* (BDISP 37*c*) by the distance S (distance T) which is from 3.0 mm, or 3.5 mm, or 3.9 mm, to 4.0 mm, or 4.5 mm, or 5.0 mm, or 5.2 mm, or 5.3 mm, or 5.5 mm.

In an embodiment, the distal inner seal arc 39*a* (39*c*) has a radius of curvature from 0 mm, or greater than 0 mm, or 1.0 mm to 19.0 mm, or 20.0 mm.

In an embodiment, each peripheral tapered seal 40*a*-40*d* (outside edge) and an extended line from respective peripheral seal 41 (outside edge) form an angle G as shown in FIG. 7. The angle G is from 40° or 42°, or 44°, or 45° to 46°, or 48, or 50°. In an embodiment, angle G is 45°.

The bottom segment 26 includes a pair of gussets 54 and 56 formed thereat, which are essentially extensions of the bottom faces 26*a*-26*d*. The gussets 54 and 56 can facilitate the ability of the flexible container 10 to stand upright. These gussets 54 and 56 are formed from excess material from each bottom face 26*a*-26*d* that are joined together to form the gussets 54 and 56. The triangular portions of the gussets 54 and 56 comprise two adjacent bottom segment panels sealed together and extending into its respective gusset. For example, adjacent bottom faces 26*a* and 26*d* extend beyond the plane of their bottom surface along an intersecting edge and are sealed together to form one side of a first gusset 54. Similarly, adjacent bottom faces 26*c* and 26*d* extend beyond the plane of their bottom surface along an intersecting edge and are sealed together to form the other side of the first gusset 54. Likewise, a second gusset 56 is similarly formed from adjacent bottom faces 26*a*-26*b* and 26*b*-26*c*. The gussets 54 and 56 can contact a portion of the bottom segment 26, where the gussets 54 and 56 can contact bottom faces 26*b* and 26*d* covering them, while bottom segment panels 26*a* and 26*c* remain exposed at the bottom end 46.

As shown in FIGS. 1-2, the gussets 54 and 56 of the flexible container 10 can further extend into the bottom handle 14. In the aspect where the gussets 54 and 56 are positioned adjacent bottom segment panels 26*b* and 26*d*, the bottom handle 14 can also extend across bottom faces 26*b* and 26*d*, extending between the pair of panels 18 and 20. The bottom handle 14 can be positioned along a center portion or midpoint of the bottom segment 26 between the front panel 22 and the rear panel 24.

The bottom handle 14 can comprise up to four layers of film sealed together when four webs of film are used to make the container 10. When more than four webs are used to make the container, the handle will include the same number of webs used to produce the container. Any portion of the bottom handle 14 where all four layers are not completely sealed together by the heat-sealing method, can be adhered together in any appropriate manner, such as by a tack seal to form a fully-sealed multi-layer bottom handle 14. The bottom handle 14 can have any suitable shape and generally will take the shape of the film end. For example, typically the web of film has a rectangular shape when unwound, such that its ends have a straight edge. Therefore, the bottom handle 14 would also have a rectangular shape.

Figure 3:
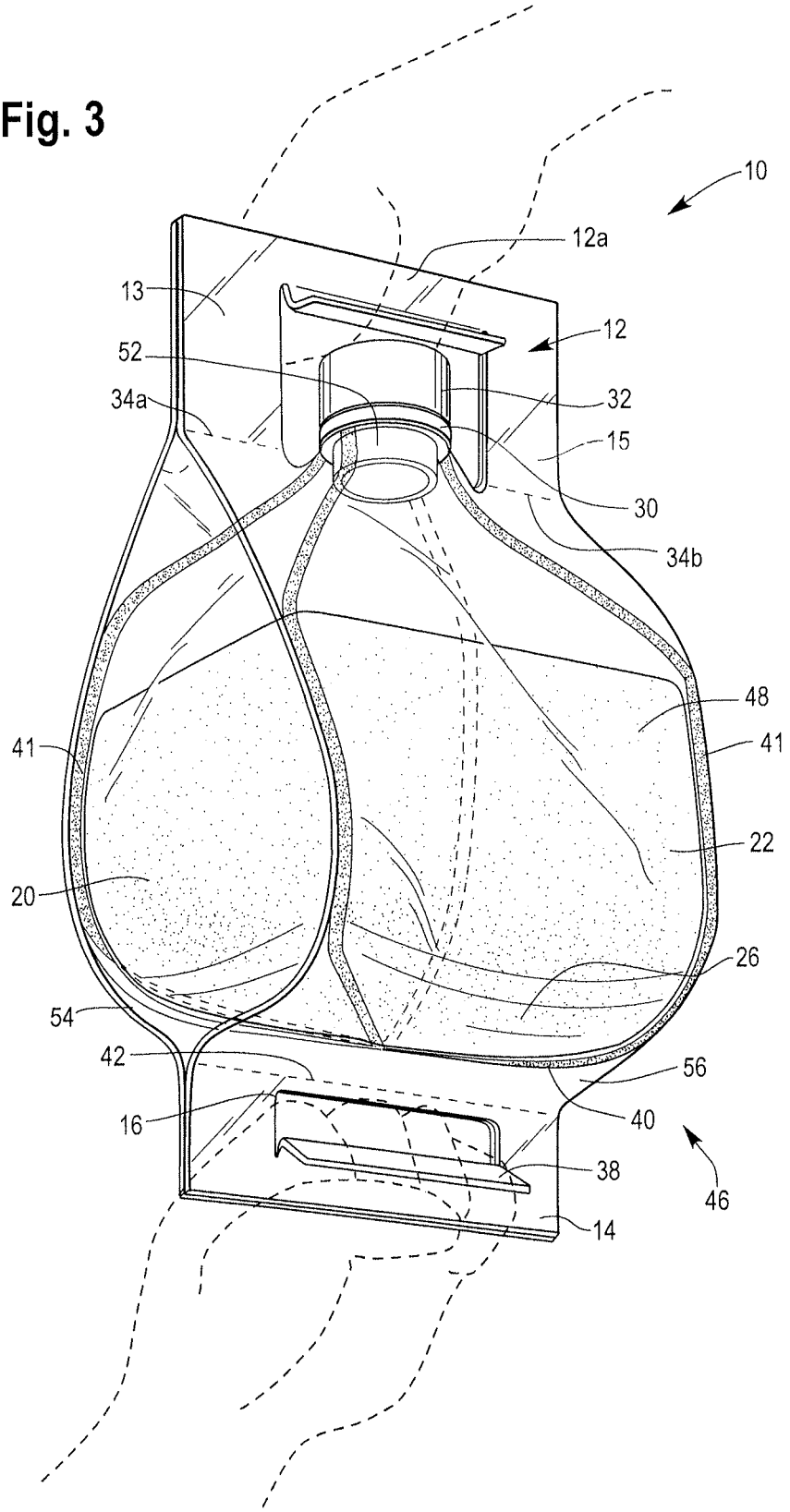
FIG. 3 is a perspective view of the flexible container of FIG. 1 shown with its top and bottom handles extended.

Additionally, the bottom handle 14 can contain a handle opening 16 or cutout section therein sized to fit a user's hand, as can be seen in FIG. 3. The opening 16 can be any shape that is convenient to fit the hand and, in one aspect, the opening 16 can have a generally oval shape. In another aspect, the opening 16 can have a generally rectangular shape. Additionally, the opening 16 of the bottom handle 14 can also have a flap 38 that comprises the cut material that forms the opening 16. To define the opening 16, the handle 14 can have a section that is cut out of the multilayer handle 14 along three sides or portions while remaining attached at a fourth side or lower portion. This provides a flap of material 38 that can be pushed through the opening 16 by the user and folded over an edge of the opening 16 to provide a relatively smooth gripping surface at an edge that contacts the user's hand. If the flap of material were completely cut out, this would leave an exposed fourth side or lower edge that could be relatively sharp and could possibly cut or scratch the hand when placed there.

Furthermore, a portion of the bottom handle 14 attached to the bottom segment 26 can contain a dead machine fold 42 or a score line that provides for the handle 14 to consistently fold in the same direction, as illustrated in FIGS. 1 and 3. The machine fold 42 can comprise a fold line that permits folding in a first direction toward the front side panel 22 and restricts folding in a second direction toward the rear panel 24. The term "restricts" as used throughout this application can mean that it is easier to move in one direction, or the first direction, than in an opposite direction, such as the second direction. The machine fold 42 can cause the handle 14 to consistently fold in the first direction because it can be thought of as providing a generally permanent fold line in the handle that is predisposed to fold in the first direction X, rather than in the second direction Y. This machine fold 42 of the bottom handle 14 can serve multiple purposes, one being that when a user is transferring the product from the container 10 they can grasp the bottom handle 14 and it will easily bend in the first direction X to assist in pouring. Secondly, when the flexible container 10 is stored in an upright position, the machine fold 42 in the bottom handle 14 encourages the handle 14 to fold in the first direction X along the machine fold 42, such that the bottom handle 14 can fold underneath the container 10 adjacent one of the bottom segment panels 26*a*, as shown in FIG. 6. The weight of the product can also apply a force to the bottom handle 14, such that the weight of the product can further press on the handle 14 and maintain the handle 14 in the folded position in the first direction X. As will be discussed herein, the top handle 12 can also contain a similar machine fold 34*a*-34*b* that also allows it to fold consistently in the same first direction X as the bottom handle 14.

Additionally, as the flexible container 10 is evacuated and less product remains, the bottom handle 14 can continue to provide support to help the flexible container 10 to remain standing upright unsupported and without tipping over. Because the bottom handle 14 is sealed generally along its entire length extending between the pair of side panels 18 and 20, it can help to keep the gussets 54 and 56 (FIG. 1, FIG. 3) together and continue to provide support to stand the container 10 upright even as the container 10 is emptied.

Figure 4:
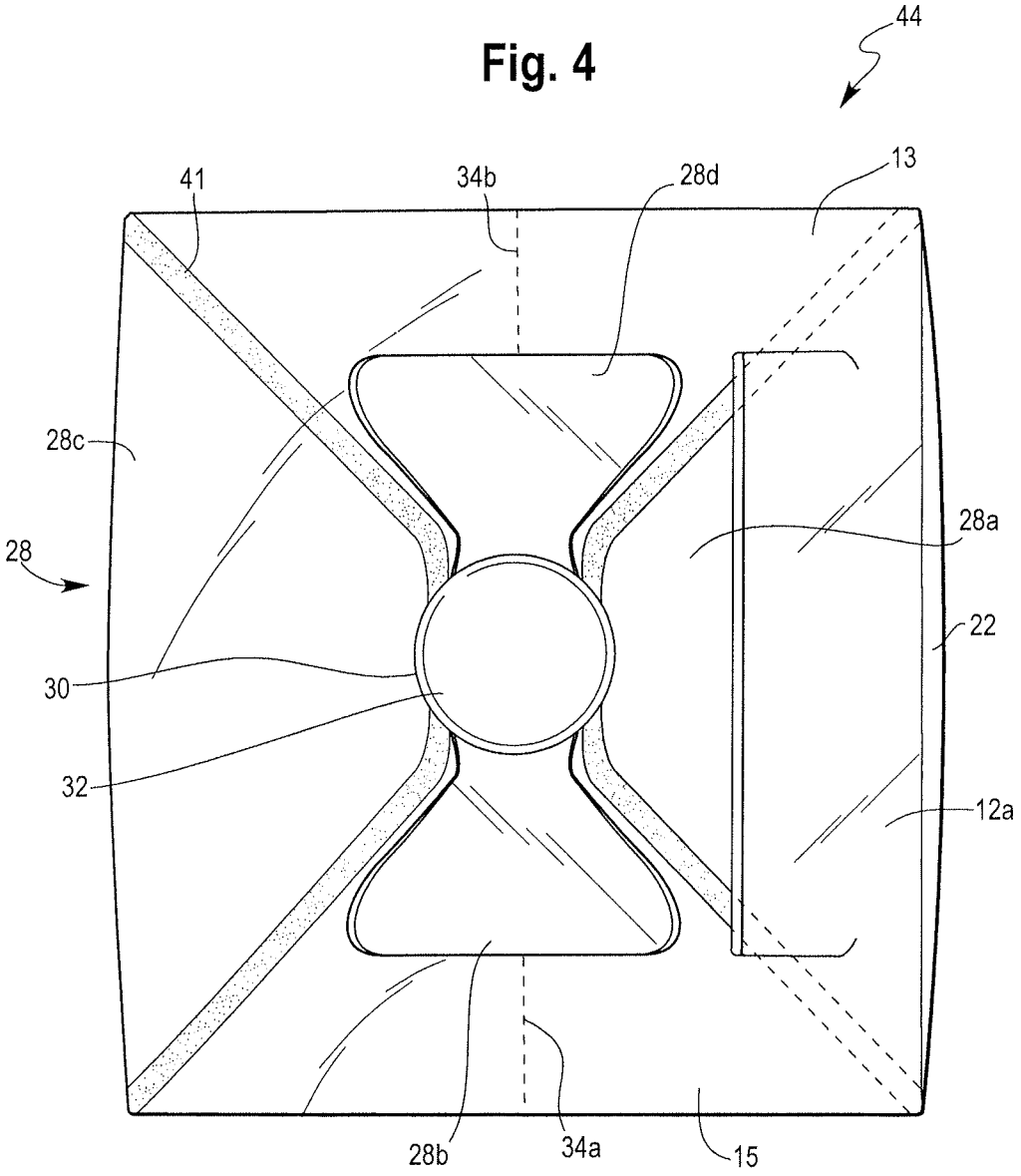
FIG. 4 is a top plan view of the flexible container of FIG. 1.

As seen in FIGS. 3-4, the top handle 12 can extend from the top segment 28 and, in particular, can extend from the four panels 28*a*-28*d* that make up the top segment 28. The four panels 28*a*-28*d* of film that extend into the top handle 12 are all sealed together to form a multi-layer top handle 12. The top handle 12 can have a U-shape and, in particular, an upside down U-shape with a horizontal upper handle portion 12*a* having a pair of spaced legs 13 and 15 extending therefrom. The legs 13 and 15 extend from the top segment 28, adjacent the spout 30 with one 13 on one side of the spout 30 and other leg 15 on the other side of the spout 30, with each leg 13, 15 extending from opposite portions of the top segment 28.

The bottommost edge of the upper handle portion 12*a* when extended in a position above the spout 30, can be just tall enough to clear the uppermost edge of the spout 30. A portion of the top handle 12 can extend above the spout 30 and above the top segment 28 when the handle 12 is extended in a position perpendicular to the top segment 28 and, in particular, the entire upper handle portion 12*a* can be above the spout 30 and the top segment 28. The two pairs of legs 13 and 15 along with the upper handle portion 12*a* together make up the handle 12 surrounding a handle opening that allows a user to place her hand therethrough and grasp the upper handle portion 12*a* of the handle 12.

As with the bottom handle 14, the top handle 12 also can have a dead machine fold 34*a*-34*b* that permits folding in a first direction toward the front side panel 22 and restricts folding in a second direction toward the rear side panel 24. The machine fold 34*a*-34*b* can be located in each leg 13, 15 at a location where the seal begins. The handle 12 can be adhered together, such as with a tack adhesive, beginning from the machine folded portion 34*a*-34*b* up to and including the horizontal upper handle portion 12*a* of the handle 12. The positioning of the machine fold 34*a*-34*b* can be in the same latitude plane as the spout 30 and, in particular, as the bottommost portion of the spout 30. The two machine folds 34*a*-34*b* in the handle 12 can allow for the handle 12 to be inclined to fold or bend consistently in the same first direction X as the bottom handle 14, rather than in the second direction Y. As shown in FIGS. 1 and 3, the handle 12 can likewise contain a flap portion 36, that folds upwards toward the upper handle portion 12*a* of the handle 12 to create a smooth gripping surface of the handle 12, as with the bottom handle 14, such that the handle material is not sharp and can protect the user's hand from getting cut on any sharp edges of the handle 12.

When the container 10 is in a rest position, such as when it is standing upright on its bottom segment 26, as shown in FIG. 1, the bottom handle 14 can be folded underneath the container 10 along the bottom machine fold 42 in the first direction X, so that it is parallel to the bottom segment 26 and adjacent bottom panel 26*a*, and the top handle 12 will automatically fold along its machine fold 34*a*-34*b* in the same first direction X, with a front surface of the handle 12 parallel to a top section or panel 28*a* of the top segment 28. The top handle 12 folds in the first direction X, rather than extending straight up, perpendicular to the top segment 28, because of the machine folds 34*a*-34*b*. Both handles 12 and 14 are inclined to fold in the same direction X, such that upon dispensing the handles can fold the same direction, relatively parallel to its respective end panel or end segment, to make dispensing easier and more controlled. Therefore, in a rest position, the handles 12 and 14 are both folded generally parallel to one another. Additionally, the flexible container 10 can stand upright even with the bottom handle 14 positioned underneath the upright flexible container 10.

Alternatively, in another aspect the flexible container can contain a fitment or pour spout positioned on a sidewall, where the top handle is essentially formed in and from the top portion or segment. The top handle can be formed from the four webs of film, each extending from its respective sidewall, extending into a sidewall or flap positioned at the top end of the container, such that the top segment of the container converges into the handle and they are one and the same, with the spout to the side of the extended handles, rather than underneath.

The material of construction of the flexible container 10 can comprise a food-grade plastic. For instance, nylon, polypropylene, polyethylene such as high density polyethylene (HDPE) and/or low density polyethylene (LDPE) may be used as discussed later. The film of the flexible container 10 can have a thickness that is adequate to maintain product and package integrity during manufacturing, distribution, product shelf life and customer usage. In an embodiment, the flexible multilayer film has a thickness from 100 micrometers, or 200 micrometers, or 250 micrometers to 300 micrometers, or 350 micrometers, or 400 micrometers. The film material can also be such that it provides the appropriate atmosphere within the flexible container 10 to maintain the product shelf life of at least about 180 days. Such films can comprise an oxygen barrier film, such as a film having a low oxygen transmission rate (OTR) from 0, or greater than 0 to 0.4, or 1.0 cc/$m^2$/24 hrs/atm) at 23° C. and 80% relative humidity (RH). Additionally, the flexible multilayer film can also comprise a water vapor barrier film, such as a film having a low water vapor transmission rate (WVTR) from 0, or greater than 0, or 0.2, or 1.0 to 5.0, or 10.0, or 15.0 g/$m^2$/24 hrs at 38° C. and 90% RH. Moreover, it may be desirable to use materials of construction having oil and/or chemical resistance particularly in the seal layer, but not limited to just the seal layer. The flexible multilayer film can be either printable or compatible to receive a pressure sensitive label or other type of label for displaying of indicia on the flexible container 10.

In an embodiment, each panel is made from a flexible multilayer film having at least one, or at least two, or at least three layers. The flexible multilayer film is resilient, flexible, deformable, and pliable. The structure and composition of the flexible multilayer film for each panel may be the same or different. For example, each of the four panels can be made from a separate web, each web having a unique structure and/or unique composition, finish, or print. Alternatively, each of the four panels can be the same structure and the same composition.

In an embodiment, each panel 18, 20, 22, 24 is a flexible multilayer film having the same structure and the same composition.

The flexible multilayer film may be (i) a coextruded multilayer structure or (ii) a laminate, or (iii) a combination of (i) and (ii). In an embodiment, the flexible multilayer film has at least three layers: a seal layer, an outer layer, and a tie layer between. The tie layer adjoins the seal layer to the outer layer. The flexible multilayer film may include one or more optional inner layers disposed between the seal layer and the outer layer.

In an embodiment, the flexible multilayer film is a coextruded film having at least two, or three, or four, or five, or six, or seven to eight, or nine, or 10, or 11, or more layers. Some methods, for example, used to construct films are by cast co-extrusion or blown co-extrusion methods, adhesive lamination, extrusion lamination, thermal lamination, and coatings such as vapor deposition. Combinations of these methods are also possible. Film layers can comprise, in addition to the polymeric materials, additives such as stabilizers, slip additives, antiblocking additives, process aids, clarifiers, nucleators, pigments or colorants, fillers and reinforcing agents, and the like as commonly used in the packaging industry. It is particularly useful to choose additives and polymeric materials that have suitable organoleptic and or optical properties.

In another embodiment, the flexible multilayer film can comprise a bladder wherein two or more films that are adhered in such a manner as to allow some delamination of one or more plies to occur during a significant impact such that the inside film maintains integrity and continues to hold contents of the container.

Nonlimiting examples of suitable polymeric materials for the seal layer include olefin-based polymer (including any ethylene/$C_3$-$C_{10}$ α-olefin copolymers linear or branched), propylene-based polymer (including plastomer and elastomer, random propylene copolymer, propylene homopolymer, and propylene impact copolymer), ethylene-based polymer (including plastomer and elastomer, high density polyethylene ("HDPE"), low density polyethylene ("LDPE"), linear low density polyethylene ("LLDPE"), medium density polyethylene ("MDPE"), ethylene-acrylic acid or ethylene-methacrylic acid and their ionomers with zinc, sodium, lithium, potassium, magnesium salts, ethylene vinyl acetate copolymers and blends thereof.

Nonlimiting examples of suitable polymeric material for the outer layer include those used to make biaxially or monoaxially oriented films for lamination as well as coextruded films. Some nonlimiting polymeric material examples are biaxially oriented polyethylene terephthalate (OPET), monoaxially oriented nylon (MON), biaxially oriented nylon (BON), and biaxially oriented polypropylene (BOPP). Other polymeric materials useful in constructing film layers for structural benefit are polypropylenes (such as propylene homopolymer, random propylene copolymer, propylene impact copolymer, thermoplastic polypropylene (TPO) and the like, propylene-based plastomers (e.g., VER- SIFY™ or VISTAMAX™)), polyamides (such as Nylon 6, Nylon 6,6, Nylon 6,66, Nylon 6,12, Nylon 12 etc.), polyethylene norbornene, cyclic olefin copolymers, polyacrylonitrile, polyesters, copolyesters (such as PETG), cellulose esters, polyethylene and copolymers of ethylene (e.g., LLDPE based on ethylene octene copolymer such as DOWLEX™, blends thereof, and multilayer combinations thereof.

Nonlimiting examples of suitable polymeric materials for the tie layer include functionalized ethylene-based polymers such as ethylene-vinyl acetate ("EVA"), polymers with maleic anhydride-grafted to polyolefins such as any polyethylene, ethylene-copolymers, or polypropylene, and ethylene acrylate copolymers such an ethylene methyl acrylate ("EMA"), glycidyl containing ethylene copolymers, propylene and ethylene based olefin block copolymers (OBC) such as INTUNE™ (PP-OBC) and INFUSE™ (PE-OBC) both available from The Dow Chemical Company, and blends thereof.

The flexible multilayer film may include additional layers which may contribute to the structural integrity or provide specific properties. The additional layers may be added by direct means or by using appropriate tie layers to the adjacent polymer layers. Polymers which may provide additional mechanical performance such as stiffness or opacity, as well polymers which may offer gas barrier properties or chemical resistance can be added to the structure.

Nonlimiting examples of suitable material for the optional barrier layer include copolymers of vinylidene chloride and methyl acrylate, methyl methacrylate or vinyl chloride (e.g., SARAN resins available from The Dow Chemical Company); vinylethylene vinyl alcohol (EVOH), metal foil (such as aluminum foil). Alternatively, modified polymeric films such as vapor deposited aluminum or silicon oxide on such films as BON, OPET, or OPP, can be used to obtain barrier properties when used in laminate multilayer film.

In an embodiment, the flexible multilayer film includes a seal layer selected from LLDPE (sold under the trade name DOWLEX™ (The Dow Chemical Company)), single-site LLDPE (substantially linear, or linear, olefin polymers, including polymers sold under the trade name AFFINITY™ or ELITE™ (The Dow Chemical Company) for example, propylene-based plastomers or elastomers such as VERSIFY™ (The Dow Chemical Company), and blends thereof. An optional tie layer is selected from either ethylene-based olefin block copolymer PE-OBC (sold as INFUSE™) or propylene-based olefin block copolymer PP-OBC (sold as INTUNE™). The outer layer includes greater than 50 wt % of resin(s) having a melting point, Tm, that is from 25° C., to 30° C., or 40° C. or higher than the melting point of the polymer in the seal layer wherein the outer layer polymer is selected from resins such as VERSIFY or VISTAMAX, ELITE™, HDPE or a propylene-based polymer such as propylene homopolymer, propylene impact copolymer or TPO.

In an embodiment, the flexible multilayer film is coextruded.

In an embodiment, flexible multilayer film includes a seal layer selected from LLDPE (sold under the trade name DOWLEX™ (The Dow Chemical Company)), single-site LLDPE (substantially linear, or linear, olefin polymers, including polymers sold under the trade name AFFINITY™ or ELITE™ (The Dow Chemical Company) for example, propylene-based plastomers or elastomers such as VERSIFY™ (The Dow Chemical Company), and blends thereof. The flexible multilayer film also includes an outer layer that is a polyamide.

In an embodiment, the flexible multilayer film is a coextruded film and includes:

(i) a seal layer composed of an olefin-based polymer having a first melt temperature less than 105° C., (Tm1); and (ii) an outer layer composed of a polymeric material having a second melt temperature, (Tm2), wherein Tm2−Tm1>40° C.

The term "Tm2−Tm1" is the difference between the melt temperature of the polymer in the outer layer and the melt temperature of the polymer in the seal layer, and is also referred to as "ΔTm." In an embodiment, the ΔTm is from 41° C., or 50° C., or 75° C., or 100° C., to 125° C., or 150° C., or 175° C., or 200° C.

In an embodiment, the flexible multilayer film is a coextruded film, the seal layer is composed of an ethylene-based polymer, such as a linear or a substantially linear polymer, or a single-site catalyzed linear or substantially linear polymer of ethylene and an alpha-olefin monomer such as 1-butene, 1-hexene or 1-octene, having a Tm from 55° C. to 115° C. and a density from 0.865 to 0.925 g/cm$^3$, or from 0.875 to 0.910 g/cm$^3$, or from 0.888 to 0.900 g/cm$^3$ and the outer layer is composed of a polyamide having a Tm from 170° C. to 270° C.

In an embodiment, the flexible multilayer film is a coextruded film having at least five layers, the coextruded film having a seal layer composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and density from 0.865 to 0.925 g/cm$^3$, or from 0.875 to 0.910 g/cm$^3$, or from 0.888 to 0.900 g/cm$^3$ and an outermost layer composed of a polyamide having a Tm from 170° C. to 270° C.

In an embodiment, the flexible multilayer film is a coextruded film having at least seven layers. The seal layer is composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and density from 0.865 to 0.925 g/cm$^3$, or from 0.875 to 0.910 g/cm$^3$, or from 0.888 to 0.900 g/cm$^3$. The outer layer is a polyamide having a Tm from 170° C. to 270° C.

In an embodiment, the flexible multilayer film includes a seal layer composed of an ethylene-based polymer, or a linear or substantially linear polymer, or a single-site catalyzed linear or substantially linear polymer of ethylene and an alpha-olefin monomer such as 1-butene, 1-hexene or 1-octene, having a heat seal initiation temperature (HSIT) from 65° C. to less than 125° C. In a further embodiment, the seal layer of the flexible multilayer film has an HSIT from 65° C., or 70° C., or 75° C., or 80° C., or 85° C., or 90° C., or 95° C., or 100° C. to 105° C., or 110° C., or 115° C., or 120° C., or less than 125° C. Applicant discovered that the seal layer with an ethylene-based polymer with a HSIT from 65° C. to less than 125° C. advantageously enables the formation of secure seals and secure sealed edges around the complex perimeter of the flexible container. The ethylene-based polymer with HSIT from 65° C. to less than 125° C. is a robust sealant which also allows for better sealing to the rigid fitment which is prone to failure. The ethylene-based polymer with HSIT from 65° C. to 125° C. enables lower heat sealing pressure/temperature during container fabrication. Lower heat seal pressure/temperature results in lower stress at the fold points of the gusset, and lower stress at the union of the films in the top segment and in the bottom segment. This improves film integrity by reducing wrinkling during the container fabrication. Reducing stresses at the folds and seams improves the finished container mechanical performance. The low HSIT ethylene-based polymer seals at a temperature below what would cause the outer layer to be compromised.

In an embodiment, the flexible multilayer film is a coextruded five layer film, or a coextruded seven layer film having at least two layers containing an ethylene-based polymer. The ethylene-based polymer may be the same or different in each layer.

In an embodiment, the flexible multilayer film is a coextruded five layer, or a coextruded seven layer film having at least two layers containing a polyamide polymer.

In an embodiment, the flexible multilayer film is a seven-layer coextruded film with a seal layer composed of an ethylene-based polymer, or a linear or substantially linear polymer, or a single-site catalyzed linear or substantially linear polymer of ethylene and an alpha-olefin monomer such as 1-butene, 1-hexene or 1-octene, having a Tm from 90° C. to 104° C. The outer layer is a polyamide having a Tm from 170° C. to 270° C. The film has a ΔTm from 40° C. to 200° C. The film has an inner layer (first inner layer) composed of a second ethylene-based polymer, different than the ethylene-based polymer in the seal layer. The film has an inner layer (second inner layer) composed of a polyamide the same or different to the polyamide in the outer layer. The seven layer film has a thickness from 100 micrometers to 250 micrometers.

Flexible container 10 has an expanded configuration (shown in FIGS. 1-6) and a collapsed configuration as shown in FIG. 7. When the container 10 is in the collapsed configuration, the flexible container is in a flattened, or in an otherwise evacuated state. The gusset panels 18, 20 fold inwardly (dotted lines of FIG. 7) and are sandwiched by the front panel 22 and the rear panel 24.

FIG. 8 shows an enlarged view of the bottom seal area 33 of FIG. 7 and the front panel 26*a*. The fold lines 60 and 62 of respective gusset panels 18, 20 are separated by a distance U that is from 0 mm, or 0.5 mm, or 1.0 mm, or 2.0 mm to 12.0 mm, or 60 mm, or greater than 60 mm. In an embodiment, distance U varies based on the size and volume of the flexible container 10. For example, the flexible container 10 may have a distance U (in mm) that is from greater than 0 mm to three times the volume (in liters) of the container. For example, a 2-liter flexible container can have a distance U from greater than 0 to less than or equal to 6.0 mm. In another example, a 20-liter flexible container 10 has a distance U that is from greater than 0 mm to less than or equal to 60 mm.

FIG. 8 shows line A (defined by inner edge 29*a*) intersecting line B (defined by inner edge 29*b*) at apex point 35*a*. BDISP 37*a* is on the distal inner seal arc 39*a*. Apex point 35*a* is separated from BDISP 37*a* by distance S having a length from greater than 0 mm or 1.0 mm, or 2.0 mm, or 2.6 mm, or 3.0 mm, or 3.5 mm, or 3.9 mm to 4.0 mm, or 4.5 mm, or 5.0 mm, or 5.2 mm, or 5.5 mm, or 6.0 mm, or 6.5 mm, or 7.0 mm, or 7.5 mm, or 7.9 mm.

In FIG. 8, an overseal 64 is formed where the four peripheral tapered seals 40*a*-40*d* converge in the bottom seal area. The overseal 64 includes 4-ply portions 66, where a portion of each panel (18, 20, 22, 24) is heat sealed to a portion of every other panel. Each panel represents 1-ply in the 4-ply heat seal. The overseal 64 also includes a 2-ply portion 68 where two panels (front panel 22 and rear panel 24) are sealed together. Consequently, the "overseal," as used herein, is the area where the peripheral tapered seals converge and that is subjected to a subsequent heat seal operation (and subjected to at least two heat seal operations altogether). The overseal 64 is located in the peripheral tapered seals and does not extend into the chamber of the flexible container 10.

In an embodiment, the apex point 35*a* is located above the overseal 64. The apex point 35*a* is separated from, and does not contact the overseal 64. The BDISP 37*a* is located above the overseal 64. The BDISP 37*a* is separated from and does not contact the overseal 64.

In an embodiment, the apex point 35*a* is located between the BDISP 37*a* and the overseal 64, wherein the overseal 64 does not contact the apex point 35*a* and the overseal 64 does not contact the BDISP 37*a*.

The distance between the apex point 35*a* to the top edge of the overseal 64 is defined as distance W shown in FIG. 8. In an embodiment, the distance W has a length from 0 mm, or greater than 0 mm, or 2.0 mm, or 4.0 mm to 6.0 mm, or 8.0 mm, or 10.0 mm or 15.0 mm.

When more than four webs are used to produce the container, the portion 68 of the overseal 64 may be a 4-ply, or a 6-ply, or an 8-ply portion.

In an embodiment, the flexible container 10 has a vertical drop test pass rate from 90%, or 95% to 100%. The vertical drop test is conducted as follows. The container is filled with tap water to its nominal capacity, conditioned at 25° C. for at least 3 hours, held in an upright position from its upper handle at 1.5 m height (from the base or side of the container to the ground), and released to a free fall drop onto a concrete slab floor. If any leak is detected immediately after the drop, the test is recorded as a failure. If no leak is detected immediately after the drop, the test is recorded as a success or "pass." A minimum of twenty flexible containers are tested. A percentage for pass/fail containers is then calculated.

In an embodiment, the flexible container 10 has a side drop pass rate from 90%, or 95% to 100%. This side drop test is conducted as follows. The container is filled with tap water to its nominal capacity, conditioned at 25° C. for at least 3 hours, held in upright position from its upper handle. The flexible container is released on its side from a 1.5 m height to a free fall drop onto a concrete slab floor. If any leak is detected immediately after the drop, the test is recorded as failure. If no leak is detected immediately after the drop, the test is recorded as a success or "pass." A minimum of twenty flexible containers are tested. A percentage for pass/fail containers is then calculated.

In an embodiment, the flexible container 10 passes the stand-up test where the package is filled with water at ambient temperature and placed on a flat surface for seven days. The flexible container remains in the same position, with unaltered shape or position for the seven days.

In an embodiment, the flexible container 10 has a volume from 0.25 liters (L), or 0.5 L, or 0.75 L, or 1.0 L, or 1.5 L, or 2.5 L, or 3 L, or 3.5 L, or 4.0 L, or 4.5 L or 5.0 L to 6.0 L, or 7.0 L, or 8.0 L, or 9.0 L or 10.0 L, or 20 L, or 30 L.

The flexible container 10 can be used to store any number of flowable substances therein. In particular, a flowable food product can be stored within the flexible container 10. In one aspect, flowable food products such as salad dressings, sauces, dairy products, mayonnaise, mustard, ketchup, other condiments, beverages such as water, juice, milk, or syrup, carbonated beverages, beer, wine, animal feed, pet feed, and the like can be stored inside of the flexible container 10.

The flexible container 10 is suitable for storage of other flowable substances including, but not limited to, oil, paint, grease, chemicals, suspensions of solids in liquid, and solid particulate matter (powders, grains, granular solids).

The flexible container 10 is suitable for storage of flowable substances with higher viscosity and requiring application of a squeezing force to the container in order to discharge. Nonlimiting examples of such squeezable and flowable substances include grease, butter, margarine, soap, shampoo, animal feed, sauces, and baby food.

DEFINITIONS

The numerical ranges disclosed herein include all values from, and including, the lower value and the upper value. For ranges containing explicit values (e.g., 1 or 2, or 3 to 5, or 6, or 7) any subrange between any two explicit values is included (e.g., 1 to 2; 2 to 6; 5 to 7; 3 to 7; 5 to 6; etc.).

Unless stated to the contrary, implicit from the context, or customary in the art, all parts and percents are based on weight, and all test methods are current as of the filing date of this disclosure.

The term "composition," as used herein, refers to a mixture of materials which comprise the composition, as well as reaction products and decomposition products formed from the materials of the composition.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed.

An "ethylene-based polymer," as used herein is a polymer that contains more than 50 mole percent polymerized ethylene monomer (based on the total amount of polymerizable monomers) and, optionally, may contain at least one comonomer.

The term "heat seal initiation temperature," is minimum sealing temperature required to form a seal of significant strength, in this case, 2 lb/in (8.8 N/25.4 mm). The seal is performed in a Topwave HT tester with 0.5 seconds dwell time at 2.7 bar (40 psi) seal bar pressure. The sealed specimen is tested in an Instron Tensiomer at 10 in/min (4.2 mm/sec or 250 mm/min).

Tm or "melting point" as used herein (also referred to as a melting peak in reference to the shape of the plotted DSC curve) is typically measured by the DSC (Differential Scanning calorimetry) technique for measuring the melting points or peaks of polyolefins as described in U.S. Pat. No. 5,783,638. It should be noted that many blends comprising two or more polyolefins will have more than one melting point or peak, many individual polyolefins will comprise only one melting point or peak.

Moisture permeability is a normalized calculation performed by first measuring Water Vapor Transmission Rate (WVTR) of the film and then multiplying WVTR by the film thickness (usually thickness in units of mil). WVTR is measured at 38° C., 100% relative humidity and 1 atm pressure with a MOCON Permatran-W 3/31. For values of WVTR at 90% relative humidity the measured WVTR (at 100% relative humidity) is multiplied by 0.90. The instrument is calibrated with National Institute of Standards and Technology certified 25 μm-thick polyester film of known water vapor transport characteristics. The specimens are prepared and the WVTR is performed according to ASTM F1249. WVTR units are $g/m^2/24$ hr.

An "olefin-based polymer," as used herein is a polymer that contains more than 50 mole percent polymerized olefin monomer (based on total amount of polymerizable monomers), and optionally, may contain at least one comonomer. Nonlimiting examples of olefin-based polymer include ethylene-based polymer and propylene-based polymer.

Oxygen permeability is a normalized calculation performed by first measuring Oxygen Transmission Rate (OTR) for a given film thickness and then multiplying this measured OTR by the film thickness (usually thickness in units of mil). OTR is measured at 23° C., 50% relative humidity and 1 atm pressure with a MOCON OX-TRAN 2/20. The instrument is calibrated with National Institute of Standards and Technology certified Mylar film of known $O_2$ transport characteristics. The specimens are prepared and the OTR is performed according to ASTM D 3985. Typical OTR units are $cc/m^2/24$ hr/atm.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 mole percent polymerized propylene monomer (based on the total amount of polymerizable monomers) and, optionally, may contain at least one comonomer.

Some embodiments of the present disclosure will now be described in detail in the following Examples.

EXAMPLES

1. Materials

TABLE 1a

Composition of the Flexible Multilayer Film - for Example 1 (7 layer co-extruded flexible multilayer film)

| Material | Description | Thickness (micrometers) |
|---|---|---|
| Polyamide | Nylon 6/66 viscosity number 195 $cm^3/g$ (ISO 307 @ 0.5% in 96% $H_2SO_4$), melting point 196° C. (ISO 3146) | 12 |
| Tie Layer | Maleic anhydride grafted polyethylene 0.922 $g/cm^3$; 1.0 MI @ 2.16 Kg 190° C. | 17 |
| Polyeth- | Polyethylene density 0.916 $g/cm^3$; | 32 |

TABLE 1a-continued

| Composition of the Flexible Multilayer Film - for Example 1 (7 layer co-extruded flexible multilayer film) | | |
|---|---|---|
| Material | Description | Thickness (micrometers) |
| ylene | 1.0 MI @ 2.16 Kg 190° C. | |
| Tie Layer | Maleic anhydride grafted polyethylene 0.922 g/cm$^3$; 1.0 MI @ 2.16 Kg 190° C. | 20 |
| Polyamide | Nylon 6/66 viscosity number 195 cm$^3$/g (ISO 307 @ 0.5% in 96% $H_2SO_4$), melting point 196° C. (ISO 3146) | 12 |
| Tie Layer | Maleic anhydride grafted polyethylene 0.922 g/cm$^3$; 1.0 MI @ 2.16 Kg 190° C. | 20 |
| Heat Seal Layer* | Ethylene alpha-olefin copolymer 0.899 g/cm$^3$; 1.0 MI @ 2.16 Kg 190° C. | 37 |

*seal layer includes an anti-block agent to facilitate handling of the film during manufacturing of the container.

TABLE 1b

| Composition of Baseline Film (5-layer laminated flexible multilayer film, film 1006 available from Smart Bottle, Inc.) | | |
|---|---|---|
| Material | Description | Thickness (micrometers) |
| Polyamide | Nylon 66 viscosity number 260 cm$^3$/g (ISO 307 @ 0.5% in 96% $H_2SO_4$), melting point 265° C. (ISO 3146) | 18 |
| Lam. Adhesive | Polyurethane Solvent Based Adhesive | 4 |
| Polyethylene | Linear Low Density Polyethylene 0.922 g/cm$^3$; 1.0 MI @ 2.16 Kg 190° C. | 25 |
| Polyethylene | Linear Low Density Polyethylene 0.923 g/cm$^3$; 0.7 MI @ 2.16 Kg 190° C. | 76 |
| Heat Seal Layer | Long chain branched, low density polyethylene 0.916 g/cm$^3$; 1.0 MI @ 2.16 Kg 190° C. | 28 |

Properties for baseline film (comparative) and the Example 1 film are provided in Table 2 below.

TABLE 2

| Film Properties for Example 1 Film and Baseline Film (comparative) | | | | |
|---|---|---|---|---|
| Property | Method | Units | Baseline | Example 1 |
| Dart Drop test | ASTM D1709 | g | 1260 | 1500 |
| Puncture resistance | Internal method | J/cm$^3$ | 5.0 +/− 0.2 | 6.6 +/− 0.6 |
| 2% Secant Modulus, machine direction (MD) | ASTM D882 | MPa | 253 +/− 5 | 172 +/12 |
| 2% Secant Modulus, cross direction (CD) | ASTM D882 | MPa | 269 +/− 10 | 180 +/− 15 |
| Film Thickness | ASTM D6988 | Micrometers | 142 +/− 2 | 152 +/− 2 |
| Elmendorf Tear, MD | ASTM D1992 | g | 524 +/− 72 | 5553 +/− 692 |
| Elmendorf Tear, CD | ASTM D1993 | g | 816 +/− 33 | 5471 +/− 979 |
| Tensile Strength MD | ASTM D882 | MPa | 26.3 +/− 1.4 | 31.2 +/− 0.7 |
| Strain at Tensile Strength MD | ASTM D882 | % | 371 +/− 17 | 434 +/− 12 |
| Tensile Strength CD | ASTM D882 | MPa | 26.7 +/− 1.7 | 31.0 +/− 1.3 |
| Strain at tensile Strength CD | ASTM D882 | % | 394 +/− 9 | 468 +/− 9 |

g—gram
MPa—megapascal

Flexible containers with a volume of 3.875 L are made using each film—Example 1 film and the baseline film. The flexible containers are made under the same heat seal conditions and have the container geometry as described herein. In particular, each flexible container tested has the bottom geometry as shown in FIG. 2 & FIG. 7 and an overseal shown in FIG. 8. The distance between the apex point and BDISP (i.e., distance S) is varied.

The flexible containers are subjected to the side drop test. The side drop test is performed under the parameters as disclosed herein. The results of the side drop test are shown in Table 3 below.

TABLE 3

| | Inner Seal Distance | 1.5 meter Side Drop Test (min 20 bottles) | |
|---|---|---|---|
| Angle G | between Front Panel BDISP and Apex Point (Distance S) | Example 1 Film % Flexible Containers Passed | Baseline Film % Flexible Containers Passed |
| 45° | 0 | 90% | 30% |
| 45° | 2.63 | 100% | 68% |
| 45° | 3.95 | 100% | 50% |
| 45° | 5.26 | 95% | 45% |
| 45° | 7.89 | 60% | 35% |
| 60° | 2.63 | 55% | 32% |

It is specifically intended that the present disclosure not be limited to the embodiments and illustrations contained herein, but include modified forms of those embodiments including portions of the embodiments and combinations of elements of different embodiments as come with the scope of the following claims.

The invention claimed is:

1. A flexible container comprising:

A. a front panel, a rear panel, a first gusseted side panel, and a second gusseted side panel, the gusseted side panels adjoining the front panel and the rear panel along peripheral seals to form a chamber;

B. each panel includes a bottom face comprising two opposing peripheral tapered seals, each peripheral tapered seal extending from a respective peripheral seal, each peripheral tapered seal comprising an inner edge, the peripheral tapered seals converging at a bottom seal area;

C. the front panel bottom face comprises a first line defined by the inner edge of the first peripheral tapered seal and a second line defined by the inner edge of the second peripheral tapered seal inner edge, the first line intersecting the second line at an apex point in the bottom seal area;

D. the front panel bottom face comprises a distal inner seal arc diverging from the inner edges, and a bottom distalmost inner seal point is located on the distal inner seal arc; and E. the apex point is separated from the bottom distalmost inner seal point by a distance from greater than 0 mm to less than 8.0 mm.

2. The flexible container of claim 1 wherein the distance from the apex point to the bottom distalmost inner seal point is from greater than 0 mm to less than 6.0 mm.

3. The flexible container of claim 1 wherein the distal inner seal arc has a radius of curvature from greater than 0 mm to 20 mm.

4. The flexible container of claim 1 wherein each peripheral tapered seal and an extended line from the respective peripheral seal form an angle, and the angle is from 40° to 50°.

5. The flexible container of claim 1 wherein each panel is a multilayer film.

6. The flexible container of claim 1 comprising an overseal in the bottom seal area.

7. The flexible container of claim 6 wherein the bottom distalmost inner seal point is located above the overseal.

8. The flexible container of claim 6 wherein the apex point is located between the bottom distalmost inner seal point and the overseal.

9. The flexible container of claim 1 wherein the panels are adjoined to define a chamber that has a spout and a rigid fitment is in the spout.

10. The flexible container of claim 9 wherein the spout is located on a top segment of the container.

11. The flexible container of claim 9 wherein the spout is located on a panel of the flexible container.

12. The flexible container of claim 1 comprising a top handle.

13. The flexible container of claim 1 comprising a bottom handle.

14. The flexible container of claim 1 comprising a bladder.

15. The flexible container of claim 1 wherein the first gusseted side panel and the second gusseted side panel each has a respective gusset panel fold line, and when the flexible container is in the collapsed configuration, the gusset panel fold lines are separated by a gap from 0 mm to 60 mm.

16. The flexible container of claim 1 wherein each panel is made from a flexible multilayer film having a seal layer comprising an ethylene-based polymer.

17. The flexible container of claim 16 wherein the ethylene-based polymer has a heat seal initiation seal temperature from greater than 65° C. to less than 125° C.

18. The flexible container of claim 17 wherein the ethylene-based polymer has a melting point, Tm, of less than 110° C.

19. The flexible container of claim 16 wherein the ethylene-based polymer is a linear ethylene-based polymer or a substantially linear ethylene-based polymer.

* * * * *